United States Patent [19]

Swanson

[11] Patent Number: 4,691,085

[45] Date of Patent: Sep. 1, 1987

[54] HIGH VOLTAGE INTERRUPTING SWITCH WITH IMPROVED CONTACT CONNECTION ARRANGEMENT AND METHOD

[75] Inventor: Roy T. Swanson, N. Riverside, Ill.

[73] Assignee: S&C Electric Company, Chicago, Ill.

[21] Appl. No.: 810,792

[22] Filed: Dec. 19, 1985

[51] Int. Cl.[4] ..... H01H 33/06

[52] U.S. Cl. ..... 200/151; 200/144 R

[58] Field of Search ..... 200/151, 144 R; 337/408

[56] References Cited

U.S. PATENT DOCUMENTS

| | | | |
|---|---|---|---|
| 4,276,531 | 6/1981 | Davis | 337/408 |
| 4,342,978 | 8/1982 | Meister | 337/6 |
| 4,370,531 | 1/1983 | Tobin | 200/151 |
| 4,460,886 | 7/1984 | Jarosz et al. | 337/148 |
| 4,467,307 | 8/1984 | Jackson | 337/30 |
| 4,490,707 | 12/1984 | O'Leary | 337/6 |
| 4,494,103 | 1/1985 | Jarosz et al. | 337/282 |
| 4,499,446 | 2/1985 | Swanson | 337/30 |

OTHER PUBLICATIONS

S&C Power Fuses Types SM-4 and SM-5, S&C Electric Company Descriptive Bulletin 242-30 dated Apr. 30, 1984.

*Primary Examiner*—Robert S. Macon

*Attorney, Agent, or Firm*—James V. Lapacek

[57] ABSTRACT

An improved high-voltage interrupting switch or interrupter and method of assembly and operation thereof is provided. The switch is of the type including a pair of contacts which are normally electrically interconnected and which are rapidly driven apart and separated to form a gap therebetween, thereby opening the switch. In preferred arrangements, one contact is stationary while a second contact is movable, although both may be movable. One of the contacts, preferably the stationary contact, contains a bore into which a portion of the second contact is telescoped. The second contact is arranged to receive a member to expand portions of the second contact to provide reliable, direct electrical interconnection of the stationary and movable contacts. In a specific arrangement wherein the stationary contact includes a conductive tube and the movable contact is partially telescoped into the bore of the stationary contact, the movable contact includes a bore for receiving a member. The member includes a tapered portion that, upon insertion into the bore of the movable contact, provides a radially-expansive force to a portion of the movable contact. The radially-expansive force expands the movable contact into desired, secure engagement against the interior of the stationary-contact conductive tube to provide electrical interconnection between the movable and stationary contacts. A piston disposed in the bore of the stationary contact is driven out of the bore of the stationary contact and moves the movable contact away from the stationary contact so as to separate the contacts and thereby open the switch. In a preferred arrangement, the member extends beyond the movable contact and is tapered such that the movement of the piston releases the member within the movable contact; thereafter, the member and the movable contact moving together in response to the piston. In a specific arrangement, the switch includes a second stationary-contact conductive tube that is aligned with the first stationary contact and the movable contact. The end of the movable contact opposite the first stationary contact is partially telescoped into the second stationary contact. The member extends throughout the length of the movable contact and includes a tapered portion adjacent the second stationary contact. Upon insertion of the member into the movable contact, the tapered portions are arranged to provide a radially-expansive force to a respective portion of the movable contact. The radially-expansive force expands portions of the movable contact into engagement with portions of the stationary-contact conductive tubes.

25 Claims, 2 Drawing Figures

HIGH VOLTAGE INTERRUPTING SWITCH WITH IMPROVED CONTACT CONNECTION ARRANGEMENT AND METHOD

BACKGROUND OF THE INVENTION

1. Field of the Invention

The present invention relates to an improved high-voltage interrupting switch or interrupter and an improved method and arrangement for providing reliable and efficient electrical connection and disconnection of the contacts. The present invention is an improvement over the switches disclosed and claimed in the following, commonly assigned U.S. Pat. Nos.: 4,342,978; 4,370,531; 4,460,886; 4,467,307; 4,490,707; 4,494,103; and 4,499,446 which are hereby incorporated by reference for all purposes.

2. Description of the Related Art

The aforementioned patents relate to various aspects of a high-voltage interrupting switch and a high-voltage interrupting module containing the switch. The switch includes contacts defining one or more contact pairs which are normally electrically interconnected by either direct engagement therebetween, or by interconection via a shearable or tearable metallic disc, membrane, or diaphragm. In preferred arrangements, one contact in each pair is stationary and the other contact is movable, although both may be movable. The contacts are rapidly separated by relative movement apart along a fixed line of direction to open a gap therebetween, thereby opening the switch. One of the contacts, preferably the stationary contact, contains a bore in which a piston is positioned.

In a specific arrangement of the interrupting module, a fusible element is provided in electrical shunt with the switch; the switch and the fusible element preferably residing within a common housing. When the switch is closed (i.e., when the contacts thereof are electrically interconected), the impedance of the current path through the switch is much lower than the impedance of the current path through the fusible element, and accordingly a negligible portion of the current flowing through the module flows through the fusible element. The switch is designed to carry much higher currents than the fusible element. Thus, the module has a high continuous current rating. When an overcurrent condition exists, the piston is arranged to be rapidly moved and drives the movable contact away from the stationary contact to disconnect and break the normal electrical interconnection. Upon opening of the switch, the contacts separate and current is rapidly commutated from the switch to the fusible element where it is interrupted. The switch is required to transfer or commutate high currents from the main current path of the switch to the fusible element. Specifically, the maximum instantaneous current that the switch can rapidly transfer into the fusible element can be a limiting factor regarding the maximum interrupting capability of the interrupting module and the capability to interrupt high-frequency currents. For higher voltage and current ratings, the mass of the movable portion of the switch is greater requiring increased operating forces to reduce the delay in moving the mass of the movable portion of the switch.

In specific arrangements of the switch, a second stationary contact is included. While the switch is closed, the movable contact and the second stationary contact are electrically interconnected in similar fashion as the first stationary contact. When the piston is moved, the movable contact moves away from the first stationary contact and is telescoped into a bore formed in the second stationary contact. This bore may be lined with an insulative sleeve and the movable contact may be covered with an insulative sleeve, so that such telescoping results in the formation of a second gap between the movable contact and the second stationary contact. The second gap is electrically insulated by the reception of the insulative sleeve of the movable contact within the insulative sleeve of the bore of the second stationary contact.

During operation, the movable contact moves rapidly away from the first stationary contact and through a passageway in an insulative liner, into which the piston may also enter. The piston entering the passageway in the liner compresses and extinguishes the arc that forms between the movable contact and the first stationary contact. The piston may be insulative in which case the first gap that is formed, between the end of the first stationary contact and the movable contact, is insulated by the reception of the piston within the insulative liner. In a preferred arrangement of the switch, the stationary contacts and the liner are engageably surrounded, and have their relative positions fixed, by an insulative housing, which maintains the stationary contacts and the liner end-to-end with the bores and the passageway being axially aligned.

Considering now in more detail the various manners in which the stationary contacts and the movable contact are electrically interconnected in the aforementioned patents, U.S. Pat. No. 4,342,978 in FIGS. 3 through 5 and U.S. Pat. No. 4,370,531 in FIGS. 2 and 3 illustrate interconnection between a stationary contact and a movable contact via direct engagement by partial telescoping of the movable contact into the stationary contact. The telescoping or sliding engagement is provided either by solid members or by fingers provided on the movable contact. In FIG. 6 of U.S. Pat. No. 4,342,978 and in FIGS. 4 and 5 of U.S. Pat. No. 4,370,531, an additional conductive member is utilized to provide electrical interconnection between the movable contact and the stationary contact; the additional conductive member being a metallic disk or membrane which is shearable or tearable upon movement of the piston as the movable contact moves away from the stationary contact. In U.S. Pat. No. 4,342,978, the additional conductive member is referred to as a diaphragm and is identifed by reference numeral 162 in FIGS. 6 and 7. The diaphragm 162 is brazed or soldered to a conductive member 78 with the combination providing the movable contact 58. The diaphragm 162 is also positioned into and attached to the groove 160 of the stationary contact 56. In FIG. 4 of U.S. Pat. No. 4,370,531, the member 112 is attached between one end of a tube 106 of the stationary contact 61 and one end of a rod 110 of the movable contact 60. As the contacts 60,61 are separated by movement of the piston, the member 112 is severed, ripped, torn, or otherwise rendered discontinuous at 112*a;* a portion 112*b* remaining attached to the stationary contact 61 and a portion 112*c* remaining attached to the movable contact 60. A second member 120 electrically interconnects the movable contact 60 to the second stationary contact 92. The member 120 is attached to the rod 110 of the movable contact 60 by a connector 122. A member 112' similar to the diaphragm 112 of FIG. 4 is illustrated in the arrangement of FIG. 5 of U.S. Pat. No. 4,370,531. In switches of this type, the member 112, 112' or 162 may also be brazed to the stationary contact to provide a suitable electrical connection.

While the aforementioned arrangements may be generally suitable for their intended use, it would be advantageous to provide reliable electrical interconnection of the contacts of such interrupting switches in a more efficient manner while reducing the operating force required to cause disconnection of the electrical interconnection and separation of the contacts, and avoiding the necessity of a frangible or shearable connection between the stationary and movable contacts to accomplish the electrical interconnection. Additionally, it would be advantageous to provide a lower cost method of interconnection of such contacts.

SUMMARY OF THE INVENTION

Accordingly, it is a principal object of the present invention to provide an improved high-voltage interrupting switch or interrupter and method of assembly thereof including an efficient arrangement for providing reliable electrical interconnection of the movable and stationary contacts of the switch, exhibiting a desirably low operating force to cause separation of the contacts, and avoiding the use of frangible or shearable connections between the stationary and movable contacts.

The preferred embodiment of the present invention provides an improved high-voltage interrupting switch and method of assembly and operation thereof. The switch, in the preferred embodiment is of the type including a pair of contacts which are normally electrically interconnected and which are rapidly driven apart and separated to form a gap therebetween, thereby opening the switch. In preferred arrangements, one contact is stationary while a second contact is movable, although both may be movable. One of the contacts, preferably the stationary contact, contains a bore into which a portion of the second contact is telescoped. The second contact is arranged to receive a member to expand portions of the second contact to provide reliable, direct electrical interconnection of the stationary and movable contacts. In a specific arrangement wherein the stationary contact includes a conductive tube and the movable contact is partially telescoped into the bore of the stationary contact, the movable contact includes a bore for receiving a member. The member includes a tapered portion that, upon insertion into the bore of the movable contact, spreads or expands the exterior of a portion of the movable contact into desired, secure engagement against the interior of the stationary-contact conductive tube to provide electrical interconnection between the movable and stationary contacts. A piston disposed in the bore of the stationary contact is driven out of the bore of the stationary contact and moves the movable contact away from the stationary contact so as to separate the contacts and thereby open the switch. In a preferred arrangement, the member extends beyond the movable contact and is tapered such that the movement of the piston releases the member within the movable contact; thereafter, the member and the movable contact moving together in response to the piston. In a specific arrangement, the switch includes a second stationary-contact conductive tube that is aligned with the first stationary contact and the movable contact. The end of the movable contact opposite the first stationary contact is partially telescoped into the second stationary contact. The member extends throughout the length of the movable contact and includes a tapered portion adjacent the second stationary contact. Upon insertion of the member into the movable contact, the tapered portions are arranged to provide a radially-expansive force to a respective portion of the movable contact. The radially-expansive force expands portions of the movable contact into engagement with portions of the stationary-contact conductive tubes. When the piston is moved, the movable contact moves away from the first stationary contact and is telescoped into the bore of the second stationary contact. The bore of the second stationary contact may be lined with an insulative sleeve and the movable contact may be covered with an insulative sleeve, so that such telescoping results in the formation of a second gap between the movable contact and the second stationary contact. An insulative liner is provided between the stationary contacts into which the piston enters. The piston which may be insulative enters the insulative liner and compresses and extinguishes the arc that forms between the movable contact and the first contact.

In various arrangements of the present invention, the bore of the movable contact and the tapered portions of the member are suitably dimensioned in various manners to cooperate for the accomplishment of the desired electrical interconnection upon insertion of the member into the movable contact. Additionally, the member is not required to be conductive and may be fabricated from any suitable material that provides the appropriate characteristics to accomplish the contact-engagement forces between the movable contact and the stationary contacts.

Accordingly, the present invention eliminates the need for a frangible or shearable connection between the stationary and movable contacts and provides a simplified and efficient method of electrical interconnection without the necessity of brazing operations or the like. Further, the release feature of the member permits the contacts to be separated with lower operating forces. Additionally, the low-impedance electrical connection provided by the present invention enables the switch to carry higher currents than previous arrangements.

BRIEF DESCRIPTION OF THE DRAWING

The invention, both as to its organization and method of operation, together with further objects and advantages thereof, will best be understood by reference to the accompanying drawing in which.

DETAILED DESCRIPTION

Figure 1:
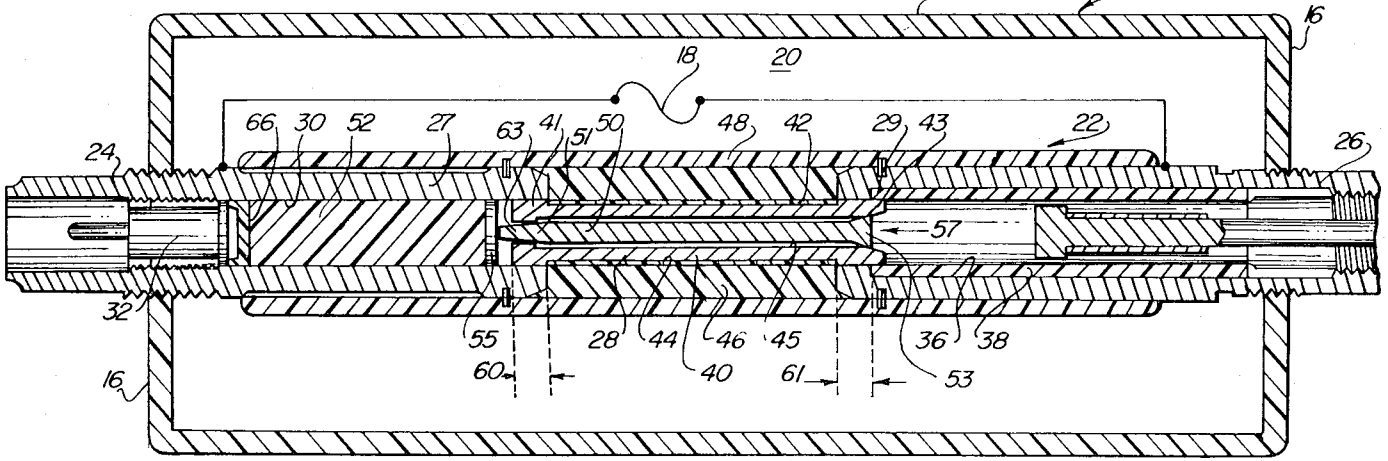
FIG. 1 is a sectional view of the high-voltage interrupting switch of the present invention illustrated within an interrupting module.

Referring to FIG. 1, the switch 22 of the present invention is suitable for use as part of a module 12. The molecule 12 includes a generally cylindrical, open-ended insulative housing 14, which is closed by end plates 16. The housing and end plates 14 and 16 surround a fusible element generally referred to at 18 and may also surround a mass 20 of a particulate fulgurite-forming medium, such as silica sand. The silica sand is in intimate engagement with one or more fusible elements 18. The fusible element 18, which may be silver, copper, or the like and the sand 20 interrupt fault currents or other over-currents therethrough in a current-limiting or energy-limiting manner, according to well-known principles. The fusible element 18 may be similar to those disclosed in U.S. Pat. Nos. 4,359,708 and 4,481,495. The housing 14 also surrounds the switch 22.

The switch 22, which is improved by the present invention, may be generally constructed in accordance with the aforemetnioned U.S. Pat. Nos. 4,342,978; 4,370,531; 4,490,707; 4,494,103; 4,460,886; 4,467,307; and 4,499,446. The switch 22 includes a first conductive member 24, to which the left end plate 16 is attached, and a second conductive member 26 to which the right end plate 16 is attached. The first conductive member 24 serves as a first stationary contact of the switch 22, while the second conductive member 26 serves as a second stationary contact of the switch 22. The ends of the fusible element 18 may be rendered electrically continuous with the stationary contacts 24 and 26 by facilities (not shown) described more fully in U.S. Pat. No. 4,491,820 The switch 22 also includes a movable contact 28. Normally, the movable contact 28 is electrically continuous with both stationary contacts 24 and 26 so that a continuous low-impedance electrical path is formed between the members 24 and 26 via the movable contact 28. Because the impedance of this path is much lower than the impedance of the fusible element 18, while the switch 22 is closed, as depicted in FIG. 1, all but a negligible portion of the current flowing through the module 12 is normally shunted through the switch 22 and away from the fusible element 18. The switch 22 is designed to carry much higher currents than the fusible element 18. When the switch 22 opens, the current formerly flowing through the stationary contacts 24 and 26 and the movable contact 28 is commutated to the fusible element 18 for interruption.

The first stationary contact 24 has a central bore 30. At the left end of the central bore 30, a power cartridge 32 or other pressure-generating device may be located. The second stationary contact 26 also contains a central bore 36. This bore 36 may be lined with an insulative sleeve 38. The movable contact 28 comprises a conductive tube or sleeve 40 surrounded by an insulative sleeve 42. The movable contact 28 is normally located between the stationary contacts 24 and 26 and within a passageway 44 formed through an insulative liner 46 between the stationary contacts 24 and 26. To the left of the movable contact 28 is located an insulative piston 52. Preferably, a drive disk 55 is provided intermediate the piston 52 and the movable contact 28 to prevent extrusion of the piston 52 when it drives the movable contact 28. In the unoperated position of the movable contact 28 shown in FIG. 1, the piston 52 normally occupies the bore 30 in the first stationary contact 24 and the movable contact 28 occupies the passageway 44 in the liner 46.

The interior of the insulative sleeve 38 is sufficiently large to receive the conductive member 40 with its insulative sleeve 42 thereon. Further, the bore 30 of the stationary contact 24 is sufficiently large, at least over portion 27, to receive the conductive member 40. The passageway 44 of the liner 46 is suitably dimensioned to receive the conductive member 40 with the insulative sleeve 42 thereon and the piston 52. In preferred embodiments, the bores 30 and 36, the passageway 44, the movable contact 28, the piston 52, and the interior of the sleeve 38 all have circular cross-sections.

The stationary contacts 24 and 26 with the liner 46 are held with the bores 30 and 36 and the passageway 44 aligned therebetween by an insulative housing 48 which engageably surrounds the stationary contacts 24 and 26 which are affixed thereto in a convenient manner. If desired, the liner 46 may overlap the stationary contacts 24 and 26 in accordance with the invention disclosed in commonly assigned U.S. application Ser. No. 525,516 filed Aug. 22, 1983 in the name of R. T. Swanson.

Figure 2:
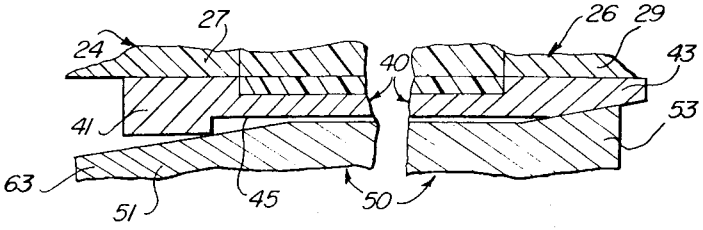
FIG. 2 is an enlarged view of portions of the switch of FIG. 1 illustrating the features of the present invention.

In accordance with important aspects of the present invention, the movable contact 28 includes or is provided with a member 50 that is received within the bore 45 of the conductive member 40 for securely and reliably electrically interconnecting the stationary contacts 24,26 and the movable contact 28. Specifically, the member 50 is inserted into the conductive member 40 in the direction 57 after the desired relative positions of the stationary contacts 24,26 and the movable contact 28 have been achieved during assembly of the switch 22. The insertion of the member 50 to the position shown in FIG. 1 applies a radially-expansive force to expand the exterior of the end portions 41 and 43 of the conductive member 40 into secure electrical connection (contact-engagement) with the interiors of the respective end portions 27 and 29 of the stationary contacts 24 and 26 respectively. To this end and referring additionally to FIG. 2, the end portions 51 and 53 of the member 50 are suitably dimensioned and tapered in accordance with the internal dimensions of the end portions 41 and 43 of the conductive member 40 to achieve the desired electrical interconnection and engagement of the stationary contacts 24,26 at portions 27,29 by the end portions 41,43 of the conductive member 40. The tapers of the portions 51 and 53 are preferably arranged so that expansion occurs when the member 50 is inserted in the direction 57 which is opposite to the direction of movement of the movable contact 28 during operation for purposes as will be explained in more detail hereinafter. Additionally, as illustrated at 63, it is preferred that the end portion 51 of the member 50 extend into the bore 30 of the stationary contact 24 beyond the end of the conductive member 40. The bore 45 at the end portions 41,43 of the conductive member 40 may be tapered to conform to the taper of the end portions 51,53 respectively of the member 50. In specific embodiments, this conformance may provide a more uniform expansion of the exterior of the end portions 41,43 and may reduce localized points of stress along the portions 41,43. However, in the preferred embodiment, the bore 45 at the end portions 41,43 is not tapered and the member 50 is fabricated from a harder material than the conductive member 40; the insertion of the member 50 appropriately shaping the interiors of the end portions 41,43. Further, the conductive member 40 is split at each end in the preferred embodiment for ease of expansion thereof. While the member 50 may not require any taper at 51 or 53 to practice the invention, such a taper is preferable. For example, in a specific embodiment, the member 50 includes the tapers at 51,53 and the movable contact 40 at 41 includes a reduced dimension with respect to the bore 45; the bore 45 being unifrom through the remainder of the conductive member 40 with no taper or increased dimension at 43. In another specific embodiment, the taper is provided at 41 and the member 50 is of uniform cross-section except for the taper at end portion 53. In such an implementation, the member 50 may include a narrowed extending portion at 63.

The member 50 is preferably metallic. However, in other specific arrangements, the member 50 is fabricated from other materials having suitable characteristics to appropriately expand the end portions 41,43 of the conductive member 40. Specifically, it should be noted that the member 50 is not required to directly provide any electrical interconnection between the movable contact 28 and the stationary contacts 24,26. However, specific arrangements of the present invention can utilize the conductive nature of the member 50, with or without conformal contact between the member 50 and the interior of the conductive member 40 along the bore 45. Of course, it will be noted that the reduced dimensions of the bore 45 at the end portion 41 of the conductive member 40 provides for expansion of the end portion 41 in response to the inserted end portion 51 of the member 50 without undesirable expansion of the conductive member 40 intermediate the end portions 41,43. Preferably, the member 51 has a circular cross-section although other cross-sections may be suitable to practice the present invention. It should also be noted that the present invention is described in conjunction with the switch 22 for illustrative purposes. However, this should not be interpreted in any limiting sense as the invention may be implemented for use with a variety of other devices.

In the normal, unoperated condition of the module 12, the switch 22 carries all but a negligible portion of the current flowing in a protected high-voltage circuit (not shown) to which the module 12 is connected. This current flows through the stationary contact 24, the movable contact 28, and the stationary contact 26. Negligible current normally flows through the fusible element 18. Should a fault current or other over-current occur in the protected circuit (not shown) to which the module 12 is connected, apparatus (not shown) detects this condition and ignites the power cartridge 32. Ignition of the power cartridge 32 causes it to evolve high-pressure gas which acts on the left end of the piston 52. Of course, it should be understood that force may be applied to rapidly move the piston 52 by means other than a pressure generator. The force applied to the piston 52 moves the piston 52 rightwardly. The drive disk 55 moves the member 50 rightwardly in FIG. 1 which removes the expansive force at the end portions 41,43 of the conductive member 40. Thereafter, the movable contact 28 including the conductive member 40, the member 50, and the insulative sleeve 42 move rightwardly. Continued rightward movement of the piston 52 and of the movable contact 28 electrically disconnects or breaks the electrical interconnection between the movable contact 28 and both stationary contacts 24 and 26; the relative positions being as shown in FIG. 3 of U.S. Pat. No. 4,467,307. Two gaps are thereby opened by the switch 22. The first gap exists between the left end of the conductive member 40 and the right end of the first stationary contact 24, while the second gap exists between the right end of the conductive member 40 and the left end of the second stationary contact 26. Both gaps are electrically insulated. Specifically, the first gap is electrically insulated by the reception of the piston 52 within the passageway 44 in the liner 46. The second gap is electrically insulated by the reception of the insulative sleeve 42 within the bore 36 of the insulative sleeve 38. The reception of the piston 52 by the passageway 44 in the liner 46 is intended to compress and extinguish the arc that forms between the movable contact 28 and the stationary contact 24. In a preferred arrangement, a lip seal 66 is provided at the end of the piston 52 proximal to the power cartridge 32 to lessen the flow of ignition products past the lip seal 66 as the piston 52 and the lip seal 66 move rightwardly as set forth more fully in U.S. Pat. No. 4,499,446. When the switch 22 opens, the current previously flowing therethrough is commutated to the fusible element 18. The action of the fusible element 18 and of the silica sand 20 ultimately extinguishes this current, as is well known.

In accordance with further aspects of the present invention, after initial movement of the piston 52 moves the member 50 rightwardly to remove the expansive forces at the end portions 41,43 of the conductive member 40, a sliding electrical connection is maintained between the movable contact 28 and the stationary contacts 24,26 upon continued rightward movement of the piston 52 due to the overlap at 60 and 61 between the movable contact 28 and the stationary contacts 24,26. After subsequent continued rightward movement of the piston 52, the piston 52 and the movable contact 28 move past the right end of the stationary contact 24 creating the first gap and the insulative sleeve 42 of the movable contact 28 moves into the insulative sleeve 38 creating the second gap. The delay in the creation of the gaps, due to the overlaps at 60,61 and the initial release of the member 50, allows the piston 52 and the movable contact 28 to accelerate to desirable high velocities before significant arc voltage is generated by the creation of the gaps. Accordingly, current transfer from the main current path to the fusible element 18 is enhanced and rapid commutation to the fusible element 18 can be achieved.

While there have been illustrated and described various embodiments of the present invention, it will be apparent that various changes and modifications will occur to those skilled in the art. For example, while the release of the member 50 by the piston 52 has been illustrated by the extension at 63 of the member 50, the invention can also be practiced by the piston 52 or other drive member contacting the member 50 in a variety of other ways including but not limited to the drive member extending into the member 40. Further, while the release of the contact-engagement force between the stationary and movable contacts has been discussed hereinbefore by applying a force to the member 50, it should also be realized that in other specific embodiments, the piston 52 or other drive element may provide release of the contact-engagement force in other manners to achieve appropriate relative movement between the member 50 and the conductive member 40. It should also be understood that the member 50 in specific embodiments is implemented by two individual members, for example, the two portions 51 and 53, which are inserted either from one end 43 of the conductive member 40 or one from each end. However, if the members are inserted, one from each end, the release feature will not be achieved in response to the contact by the piston 52. Additionally, the present invention may be practiced with switches or devices of different configuration other than as described hereinbefore; e.g., all contacts movable, one pair of contacts providing one gap, etc. Further, while the conductive member 40 has been described as a tube or sleeve in specific embodiments, various other configurations are also suitable including, for example, a split-sleeve construction. Considering the structure of the contacts 24, 26, and 28, it should be realized that in specific embodiments, the contacts 24,26 may be telescoped into the contact 28. In specific embodiments, the contact-engagement force may be applied from the exterior of the contact 28 rather than from a member 50 received within the contact 28. It is intended in the appended claims to cover all such changes and modifications as fall within the true spirit and scope of the present invention.

What is claimed and desired to be secured by Letters Patent of the United States is:

1. An improved arrangement for electrically interconnecting the separable, electrical contacts of a device in which portions of a first contact and a second contact are engaged, the device being operated in response to movement of a drive element to rapidly separate the contacts via movement of one or both contacts, wherein the improvement comprises:

a member; and means provided on the second contact and cooperating with said member for providing a contact-engagement force between the first and second contacts resulting from the insertion of at least a portion of said member or the second contact in the other and for providing the release of the contact-engagement force between the first and second contacts by relative movement between said member and the second contact in response to the movement of the drive element during device operation and in response to contact of said member by the drive element.

2. The arrangement of claim 1 wherein the device includes a third contact, the three contacts being generally aligned, portions of the second and third contacts being engaged, the arrangement further comprising a second member, and means provided on the second contact and cooperating with said second member for providing a contact-engagement force between the second and third contacts resulting from the insertion of at least a portion of said second member or the second contact into the other.

3. The arrangement of claim 1 wherein the device includes a third contact, the three contacts being generally aligned, portions of the second and third contacts being engaged, said arrangement further comprising means provided on the second contact and cooperating with said member for providing a contact-engagement force between the second and third contacts resulting from the insertion of at least a portion of said member or the second contact into the other and for providing the release of the contact-engagement force between the second and third contacts by relative movement between said member and the second contact in response to the movement of the drive element during device operation.

4. An improved arrangement for electrically interconnecting the separable, electrical contacts of a device in which portions of a first contact and a second contact are engaged and in which portions of the second contact and a third contact are engaged, the three contacts being generally aligned, the device being operated in response to movement of a drive element to rapidly separate the contacts via movement of one or both contacts, wherein the improvement comrpises:

a member; and means provided on the second contact and cooperating with said member for providing a contact-engagement force between the first and second contacts and between the second and third contacts resulting from the insertion of at least a portion of said member or the second contact into the other and for providing the release of the contact-engagement force between the first and second contacts and between the second and third contacts by relative movement between said member and the second contact in response to the movement of the drive element during device operation.

5. The arrangement of claim 1 or 4 wherein the insertion of said member or the second contact into the other defines relative movement there-between in a direction that is opposite to the direction of relative movement between said member and the second contact during device operation.

6. The arrangement of claim 1 or 4 wherein the second contact is partially telescoped into the first contact, said member being inserted into the second contact, said member and/or said contact-engagement force providing means including one or more tapered portions, each of said tapered portions being defined such that said member includes a maximum dimension that is greater than the minimum dimension of the corresponding portion of the second contact when inserted into said second contact.

7. The arrangement of claim 6 wherein said one or more tapered portions upon insertion of said member provide an expansive force to portions of the exterior of the second contact when said member is inserted into the second contact.

8. The arrangement of claim 4 wherein the second contact is partially telescoped into the first and third contacts, said contact-engagement force providing means comprising means for applying an expansive force which tends to enlarge portions of the exterior periphery of the second contact when said member is inserted into the second contact.

9. The arrangement of claim 8 wherein said expansive force is applied along the portions of the second contact that are partially telescoped into the first and third contacts.

10. The arrangement of claim 8 wherein the drive element applies a force to the second contact to rapidly drive the second contact away from the first contact and into the third contact, the drive element applying a force to said member before applying force to the second contact.

11. The arrangement of claim 10 wherein said member extends beyond the second contact and into the first contact.

12. The arrangement of claim 10 wherein said member is inserted into the second contact such that the direction of movement of the drive element relieves the expansive force applied by said member.

13. The arrangement of claim 12 wherein the direction of movement of the second contact during operation is opposite to the direction of insertion of said member into the second contact.

14. The arrangement of claim 4 wherein the first and third contacts are conductive tubes, the second contact is partially telescoped into the first and third contacts, said contact-engagement providing means comprising a central bore of the second contact having a reduced cross-section at the portion that telescopes into the first contact, said member including a tapered portion at each end thereof.

15. The arrangement of claim 14 wherein said member is inserted into the bore of the second contact to provide a radial, expansive force to the second contact at the portion that telescopes into the first and third contacts.

16. The arrangement of claim 15 wherein said member includes a narrowing taper at the leading end thereof that is proximate the first contact after insertion, and a widening taper at the trailing end thereof that is proximate the third contact after insertion.

17. The arrangement of claim 1, 8, 10, or 11 wherein the first and second contacts are telescoped a predetermined amount such that a predetermined velocity can be exceeded by the second contact during operation before the first and second contacts are no longer in telescoping relationship.

18. A method of providing electrical connection and disconnection of the separable, electrical contacts of a device of the type in which portions of a first contact and a second contact are telescoped, the device being operated in response to movement of a drive element to rapidly separate the contacts, the method comprising the steps of:

maintaining the first and second contacts in a desired relative position;

assembling a member and the second contact by insertion of at least a portion of the member or the second contact into the other to provide a contact-engagement force between the telescoped portions of the first and second contacts, thereby effecting a direct electrical connection between the first and second contacts; and as desired thereafter, releasing said contact-engagement force by relative movement between the member and the second contact in response to the movement of the drive element during device operation and in response to contact of the member by the drive element.

19. The method of claim 18 wherein the second contact is telescoped into the first contact, the assembling step further comprising inserting the member into the second contact to provide an expansive force to at least a portion of the second contact that is telescoped into the first contact.

20. The method of claim 19 wherein the drive element drives the second contact away from the first contact, the assembly step further comprising inserting the member into the second contact in a direction that is opposite to the direction in which the second contact is driven by the drive element during device operation.

21. The method of claim 20 wherein said inserting step further comprises inserting the member such that the member extends beyond the second contact at the end at which the second contact is driven, the drive element contacting the member and releasing the contact-engagement force before the drive element is in a position to drive the second contact.

22. The method of claim 18 wherein the device further includes a third contact, portions of the second contact and the third contact being telescoped, the three contacts being generally aligned, the assembly of the member with the second contact also providing a contact-engagement force between the second and third contacts, during device operation, the contact-engagement force between the second and third contacts also being released in response to the movement of the drive element.

23. An arrangement for improving the current transfer characteristics of a high-voltage interrupting device of the type which includes a main current section shunted by a fusible element, the main current section including at least first and second contacts which are rapidly separated during operation by movement of one or both contacts, wherein the improvement comprises a member, said member being assembled with one of the contacts to provide a contact-engagement force between the first and second contacts, the contact-engagement force being released during operation by selective movement between said member and said one of the contacts, the improvement further comprising arranging the first and second contacts in telescoping fashion such that predetermined relative movement occurs to release the contact-engagement force and to separate the contacts during which the first and second contacts remain electrically connected due to the predetermined telescoped portions of the contacts and such that a predetermined relative velocity between the first and second contacts can be achieved before the first and second contacts are no longer in telescoping relationship.

24. An improved arrangement for electrically interconnecting the separable, electrical contacts of a device in which portions of a first contact and a second contact are engaged and in which portions of the second contact and a third contact are engaged, the three contacts being generally aligned, the device being operated in response to movement of a drive element to rapidly separate the contacts via movement of one or both contacts, wherein the improvement comprises:

a first member;

a second member; and means provided on the second contact and cooperating with said first and second members for providing a contact-engagement force between the first and second contacts and between the second and third contacts resulting from the insertion of at least a portion of each of said first and second members or the second contact into the other and for providing the release of the contact-engagement force between the first and second contacts by relative movement between said first and second members and the second contact in response to the movement of the drive element during device operation.

25. A method of providing electrical connection and disconnection of the separable, electrical contacts of a device of the type in which portions of a first contact and a second contact are telescoped and in which a second and a third contact are telescoped, the three contacts being generally aligned, the device being operated in response to movement of a drive element to rapidly separate the contacts, the method comprising the steps of:

maintaining the first, second, and third contacts in a desired relative position;

assembling a member and the second contact by insertion of at least a portion of the member or the second contact into the other to provide a contact-engagement force between the telescoped portions of the first and second contacts and between the telescoped portions of the second and third contacts, thereby effecting a direct electrical connection between the first and second contacts and between the second and third contacts; and as desired thereafter, releasing said contact-engagement force by relative movement between the member and the second contact in response to the movement of the drive element during device operation.

* * * * *